US006464837B1

(12) United States Patent
Ruf et al.

(10) Patent No.: US 6,464,837 B1
(45) Date of Patent: Oct. 15, 2002

(54) HEADBOX AND PROCESS FOR THE METERED ADDITION OF A FLUID MEDIUM INTO A SUSPENSION STREAM OF A HEADBOX

(75) Inventors: Wolfgang Ruf, Herbrechtingen; Hans Loser, Langenau; Klaus Lehleiter, Steinheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/497,162

(22) Filed: Feb. 3, 2000

(30) Foreign Application Priority Data

Mar. 2, 1999 (DE) ..... 199 08 898

(51) Int. Cl.[7] ..... D21F 1/00
(52) U.S. Cl. ..... 162/338; 162/216; 162/258
(58) Field of Search ..... 406/46, 47, 48, 406/93, 194, 197, 336, 212, 216; 162/338, 258

(56) References Cited

U.S. PATENT DOCUMENTS

| | | | | |
|---|---|---|---|---|
| 4,897,158 A | * | 1/1990 | Weisshuhn et al. | 162/259 |
| 5,545,293 A | | 8/1996 | Houvila et al. | |
| 5,549,792 A | * | 8/1996 | Begemann et al. | 162/216 |
| 5,626,722 A | * | 5/1997 | Huovila | 162/343 |
| 5,683,551 A | | 11/1997 | Meinecke et al. | |
| 5,688,372 A | | 11/1997 | Houvila et al. | |
| 6,117,272 A | * | 9/2000 | Heinzmann | 162/216 |
| 6,136,152 A | * | 10/2000 | Begemann | 162/336 |

FOREIGN PATENT DOCUMENTS

| | | |
|---|---|---|
| DE | 3514554 | 3/1986 |
| DE | 4211291 | 10/1993 |
| DE | 4422907 | 1/1996 |
| DE | 19632673 | 2/1998 |
| EP | 0635599 A | 1/1995 |

* cited by examiner

*Primary Examiner*—Christopher P. Ellis
*Assistant Examiner*—Joe Dillon, Jr.
(74) *Attorney, Agent, or Firm*—Greenblum & Bernstein, P.L.C.

(57) ABSTRACT

Process for a metered addition of a fluid medium into a material suspension stream of a headbox, including feeding the material suspension in a main flow direction through at least one turbulence-producing conduit to a headbox nozzle, the at least one turbulence-producing conduit having an entrance, a graduated pressure loss area, and an exit. A total pressure loss $\Delta P_{total}$ is caused in the at least one turbulence-producing conduit such that the total pressure loss $\Delta P_{total}$ includes at least one intake pressure loss $\Delta P_{intake}$ formed at the entrance and a graduated pressure loss $\Delta P_{grad}$ formed at the graduated pressure loss area. A metered addition of a fluid medium is also provided in a region between the entrance and the exit. The headbox for one of a paper and cardboard machine includes at least one material suspension supply running a width of the machine, at least one turbulence producer having at least one conduit through which a material suspension flows, at least one metered suspension supply running a width of the machine, at least one turbulence producer having at least one conduit through which a material suspension flows, at least one metered addition point located in the conduit for introducing a fluid medium, and a headbox nozzle located downstream from the at least one turbulence producer for delivering the material suspension. A portion of a flow resistance located downstream of the metered addition point is at least approximately 50% of a total flow resistance of the at least one conduit.

6 Claims, 5 Drawing Sheets

HEADBOX AND PROCESS FOR THE METERED ADDITION OF A FLUID MEDIUM INTO A SUSPENSION STREAM OF A HEADBOX

CROSS-REFERENCE TO RELATED APPLICATIONS

The present application claims priority under 35 U.S.C. § 119 of German Patent Application No. 199 08 898.5, filed on Mar. 2, 1999, the disclosure of which is expressly incorporated by reference herein in its entirety.

BACKGROUND OF THE INVENTION

1. Field of the Invention

The invention relates to a process for the metered addition of a fluid medium into a material suspension stream of a headbox in which the material suspension stream in the headbox is distributed across the machine width, fed into a plurality of turbulence-producing conduits, and supplied to the headbox nozzle. Furthermore, a total pressure loss $\Delta P_{total}$ is caused in the region of the turbulence-producing conduits, including at least one intake pressure loss $\Delta P_{intake}$ created at the entrance to the conduits followed by a graduated pressure loss $\Delta P_{grad}$ created at a graduated pressure loss area defined by at least one change in cross-section inside the conduits. Furthermore, the metered addition of a fluid medium occurs in the region of the conduits, between the conduit entrance and the conduit exit.

The invention also relates to a headbox for a paper or cardboard machine having at least one material suspension supply running the width of the machine, at least one turbulence producer having a plurality of conduits through which the material suspension flows, a plurality of metered addition points for a fluid medium in the region of at least one of the conduits and an attached headbox nozzle.

2. Discussion of Background Information

DE 35 14 554 A1, describes a conventional headbox design, wherein FIG. 6 shows a headbox having a suspension supply across the width of the machine and a turbulence producer having several conduits through which a material suspension flows. The conduits have a plurality of metered addition points for introducing a fluid medium into one part of the conduits. Moreover, a headbox nozzle is attached in the turbulence producer.

the German patent also discloses a corresponding process for the metered addition of a fluid medium into a material suspension stream of a headbox in which the material suspension stream distributed across the machine width utilizes a plurality of turbulence-producing conduits which are fed by these to the headbox nozzle. In the region of the turbulence-producing conduits, a total pressure loss is produced that arises from at least the intake pressure loss in the conduits and the subsequent graduated pressure losses from cross-sectional change inside the conduits. The metered addition of the fluid medium occurs in a part of the conduits between the conduit entrance and the conduit exit.

In this conventional design, the main pressure loss of the turbulence-producing conduits occurs in the entrance region of the turbulence inserts, i.e., before the metered addition points of the fluid medium. As a result of this arrangement, changes in the flow rate through the conduits during the metered addition affect the basis weight cross profile and fiber orientation cross profile in a negative manner. One attempt to solve this problem is shown in FIG. 6 of the application cited above, in which a fluid is sprayed into the lateral distributor of the headbox near the entrance opening of a turbulence tube, i.e., before the location of the main pressure loss. This design provides for a very small influence of the metered addition on the total flow rate of the turbulence conduits, but it also has the disadvantage that no clear assignment of the added fluid to a certain turbulence conduit is given, with the working width of the metered addition also depending on the amount of the fluid added.

SUMMARY OF THE INVENTION

One object of the invention is to disclose a process for the metered addition of a fluid medium into a material suspension stream of a headbox in the region of the turbulence-producing conduits, in which the metered addition of the fluid medium has the least possible influence on the total flow rate of the respective conduit. It is also an object of the invention to disclose a headbox that is appropriate for performing the process according to the invention.

It is recognized that a fundamentally necessary pressure loss occurs in the conventional headbox designs at a turbulence insert having turbulence conduits and/or turbulence tubes chiefly by intake pressure loss at the transition between the lateral distributor of the headbox and the turbulence insert. Because only a low pressure gradient occurs in the part of the turbulence insert that is connected at the outlet side, metered fluid additions in this region have an intense and undesirable effect on the total flow rate of the respective conduit. The solution to this problem is to substantially reduce the intake pressure loss in relation to the pressure loss arising in the further course of the conduit, by an appropriate design of the turbulence conduit in the entrance region. This allows for the possibility of arranging the metered addition in the conduit at the location where the main pressure loss is placed behind the combination point of the added fluid stream with the main suspension stream inside the conduit. The influence, as a result of the amount of fluid in the metered addition which is added to the main stream, has only a very small effect on the total flow rate.

The invention provides for a process for adding a metered addition of a fluid medium into a material suspension stream of a headbox, in which the material suspension stream in the headbox is distributed across the machine width in a plurality of turbulence-producing conduits that supply the material suspension to the headbox nozzle, such that in the region of the turbulence-producing conduits a total pressure loss $\Delta P_{total}$ is caused which arises from at least one intake pressure loss $\Delta P_{intake}$ at the entrance to the conduits and which provides for a graduated pressure loss $\Delta P_{grad}$ by means of at least one cross-section change inside the conduits, in which the metered addition of the fluid medium occurs in the region of at least one of the conduits, between the conduit entrance and the conduit exit. The invention can ideally provide that at least approximately 50% of the total pressure loss $\Delta P_{total}$ is produced downstream of the metered addition of the fluid medium. Preferably, the portion of the pressure loss that occurs downstream of the metered addition of the fluid medium should amount to no more than approximately 75% of the total pressure loss $\Delta P_{total}$.

One embodiment provides for approximately 50%–60% of the total pressure loss $\Delta P_{total}$ to be produced downstream of the metered addition of the fluid medium.

This design of the headbox allows the metered addition of fluids, e.g., dilution water, into the turbulence insert of a head box wile causing only the most minimal changes in the local total flow rate at the turbulence insert and, it also allows for a clearly defined width of effect of the metered addition, in the range of normal output quantity, which is essentially independent of the amount of the metered fluid.

According to the invention, it is advantageous for the total pressure loss $\Delta P_{total}$ to be in the range of approximately $0.3\times10^5$ Pa to $8\times10^5$ Pa, with a total pressure loss in the range of approximately $4\times10^5$ Pa to $8\times10^5$ Pa being preferred (Pa representing pascal pressure units). This relatively high total pressure loss allows for a further reduction in the influence of the local total volume stream in the case of different metered additions, for example.

It may also be advantageous for the intake pressure loss $\Delta P_{intake}$ to be kept low by a venturi cross-section design in the conduit since no separation zones to the inflow ensue.

A further possibility for influencing the pressure loss distribution is by using a wave contour located downstream of the metered addition of the fluid medium in the respective conduit in order to produce the pressure loss. By utilizing the plurality of waves in the wave contour, a high pressure loss can be produced in the narrowest space with a desired turbulence structure, i.e., turbulence with short wavelengths.

Another advantageous embodiment of the process provides for the metered addition of the fluid medium in at least one conduit to occur in the direction opposite to the main flow of the material suspension. This allows an optimal mixing of the added fluid with the main stream of the material suspension.

Ideally, the metered addition of the fluid medium takes place in all conduits of the turbulence producer or at least in conduits which are evenly distributed across an entire web width. Such a design makes it possible to adjust the basis weight cross profile and/or the fiber orientation cross profile by metered additions, e.g., of backwater or another fluid whose concentration differs from the material suspension stream that is distributed across the machine width. With respect to the possibilities for influencing the fiber orientation cross profile, the basis weight cross profile, and also the basis weight profile in the z-direction, reference is made to Applications DE 44 22 907 and DE 196 32 673 A1, the full disclosures of which are incorporated by reference herein.

The invention also includes a headbox for a paper or cardboard machine having at least one material suspension supply running the width of the machine, at least one turbulence producer having a plurality of conduits through which suspension flows, a plurality of metered addition points for a fluid medium in the region of at least one of the conduits, and a subsequent headbox nozzle in which at least one of the conduits of the turbulence producer is constructed in such a way that the portion of the flow resistance downstream of the metered addition point amounts to at least approximately 50% of the total resistance of the conduit.

Preferably, the portion of the flow resistance downstream of the metered addition point should amount to no more than approximately 75% of the total resistance of the conduit. Moreover, a division of the resistances before and after the metered addition point is preferred in which approximately 50% to 60% of the total resistance is arranged downstream of the metered addition point.

Another embodiment of the headbox according to the invention provides for at least one conduit with one metered addition point in the entrance region to have a bezel. The bezel has a depth t relative to an entrance surface in the range of approximately 2 mm to 10 mm, preferably in the range of approximately 4 mm to 6 mm, and a bezel angle $\alpha$ of between approximately 20° and 80° relative to the entrance surface.

In another embodiment, the conduit with a metered addition point in the entrance region has a contour in the form of a venturi tube. By designing the entrance in this way, the flow into the turbulence conduit occurs in a resistance-free manner, as much as possible, such that the main resistance can be arranged downstream of the metered addition point of the turbulence conduit.

In still another embodiment of the invention the headbox has an exit flow opening of the metered addition point which is arranged in the opposite direction to the main flow of the material suspension in the conduit. As a result an optimal mixing of the added liquid into the material suspension stream is achieved.

It may be ideal for all conduits of the turbulence producer to have a metered addition point or for the metered addition points to be arranged in an evenly distributed manner across the machine width. This results in a particularly simple design for influencing the fiber orientation cross profile and/or the basis weight cross profile as well as the respective profile in the z-direction of the fibrous material layer that has been created.

It should be understood that the features of the invention named above and to be expanded upon below can be used not only in the combinations mentioned, but also in other combinations, or alone, without departing from the scope of the invention.

According to one aspect of the invention, there is provided a process for a metered addition of a fluid medium into a material suspension stream of a headbox which includes feeding the material suspension in a main flow direction through at least one turbulence-producing conduit to a headbox nozzle, such that the at least one turbulence-producing conduit has an entrance, a graduated pressure loss area, and an exit. A total pressure loss $\Delta P_{total}$ is caused in the at least one turbulence-producing conduit such that the total pressure loss $\Delta P_{total}$ includes at least one intake pressure loss $\Delta P_{intake}$ formed at the entrance and a graduated pressure loss $\Delta P_{grad}$ formed at the graduated pressure loss area. A metered addition of a fluid medium is also provided in a region between the entrance and the exit. At least approximately 50% of the total pressure loss $\Delta P_{total}$ may be produced downstream of the metered addition. The metered addition may brake place between the entrance and the graduate pressure loss area. The graduated pressure loss area may be defined by at least one change in cross-section.

The process allows for the total pressure loss $\Delta P_{total}$ produced downstream of the metered addition of a fluid medium to be set so that it does not exceed approximately 75%. The total pressure loss $\Delta P_{total}$ produced downstream of the metered addition of a fluid medium may be in the range of approximately 50% to 60%. The total pressure loss $\Delta_{total}$ may be any value in a range of approximately $0.3\times10^5$ Pa to $8\times10^5$ Pa, and preferably, in the range of approximately $4\times10^5$ Pa to $8\times10^5$ Pa.

The process may further provide for creating the at least one intake pressure loss $\Delta P_{intake}$ by a venturi cross-section. Alternatively, it may provide for creating the at least one intake pressure loss $\Delta P_{intake}$ by a bezel. The bezel may have a depth $\tau$ in a range of approximately 2 mm to 10 mm and an angle $\alpha$ of between approximately 20° and 80°. Preferably, the bezel has a depth $\tau$ in a range of approximately 4 mm to 6 mm and an angle $\alpha$ of between approximately 20° and 80°.

The process provides that the graduated pressure loss area include a wave contour for producing the pressure loss downstream of the metered addition. A transition section is located between the metered addition and the wave contour. The transition section includes a diffuser-like conical section. The metered addition is located in a region of greatest narrowing, such that the region of greatest narrowing is located between the entrance and the wave contour. The metered addition may occur in a direction opposite to the main flow of the material suspension.

Moreover, a plurality of turbulence-producing conduits may be used. Additionally, each conduit of the plurality has a metered addition of fluid medium Alternatively, only some conduits of the plurality have a metered addition of fluid medium. The metered addition of a fluid medium is adjusted on, at least one of, a basis weight cross profile and a fiber orientation cross profile of a manufactured web. The metered addition of a fluid may be located between the entrance and a region of greatest narrowing. The region of greatest narrowing is followed by a first diameter section which is larger than the region of greatest narrowing. The first diameter section is followed by a second larger diameter section. A transition section is located between the region of greatest narrowing and the first diameter section.

According to another aspect of the invention, there is provided a headbox for, one of, a paper and cardboard machine which includes at least one material suspension supply running a width of the machine, at least one turbulence producer having at least one conduit through which a material suspension flows, at least one metered addition point located in the conduit for introducing a fluid medium, and a headbox nozzle located downstream from the at least one turbulence producer for delivering the material suspension. A portion of a flow resistance located downstream of the metered addition point is at least approximately 50% of a total flow resistance of the at least one conduit. The flow resistance downstream of the metered addition point may be designed as no greater than approximately 75% of the total resistance of the at least one conduit. Preferably, the flow resistance downstream of the metered addition point is any value in a range of approximately 50% to 60% of the total resistance of the at least one conduit.

The at least one conduit includes an entrance region located before the metered addition point which is defined by a bezel. The bezel has a depth $\tau$ in a range of approximately 2 mm to 10 mm and an angle $\alpha$ of between approximately 20° and 80° relative to an entrance surface of the at least one conduit. Preferably, the bezel has a depth $\tau$ in a range of approximately 4 mm to 6 mm and an angle $\alpha$ of between approximately 20° and 80° relative to an entrance surface of the at least one conduit. Alternatively, the at least one conduit also includes an entrance region located before the metered addition point which is defined by a venturi tube contour. A transition section is located between the metered addition of a fluid and a wave contour. The transition section has a diffuser-like conical section. The metered addition of a fluid is located in a region of greatest narrowing, such that this region of greatest narrowing is located between the entrance and a wave contour.

The headbox provides that the at least one conduit comprises a wave contour region located downstream of the metered addition point. The at least one metered addition point includes at least one opening for delivering a fluid medium in a direction opposite to the main flow of the material suspension. The at least one turbulence producer also includes a plurality of conduits through which a material suspension flows. Some of the plurality of conduits have metered addition points. Alternatively, all of the plurality of conduits have metered addition points. Additionally, some of the plurality of conduits are arranged in an evenly distributed manner across the machine width.

According to still another aspect of the invention, there is provided a process for a metered addition of a fluid medium into a material suspension stream of a headbox which includes feeding the material suspension in a main flow direction through a plurality of turbulence-producing conduits to a headbox nozzles, such that the plurality of turbulence-producing conduits have an entrance, a graduated pressure loss area, and an exit. A total pressure loss $\Delta P_{total}$ is caused in the plurality of turbulence-producing conduits such that the total pressure loss $\Delta P_{total}$ comprises at least one intake pressure loss $\Delta P_{intake}$ formed at the entrance and a graduated pressure loss $\Delta P_{grad}$ formed at the graduated pressure loss area. A metered addition of a fluid medium is further provided in a region between the entrance and the exit. At least approximately 50% of the total pressure loss $\Delta P_{Total}$ is produced downstream of this metered addition.

According to another aspect of the invention, there is provided a headbox for, one of, a paper and cardboard machine, which includes at least one material suspension supply running a width of the machine, at least one turbulence producer having a plurality of conduits through which a material suspension flows, each conduit having the following: a narrowed entrance region which creates an initial flow resistance, a region of greatest narrowing which creates an additional flow resistance, and at least one metered addition point for introducing a fluid medium. The metered addition point is located between the narrowed entrance region and the region of greatest narrowing. A headbox nozzle is also located downstream from the at least one turbulence producer for delivering the material suspension. A portion of a flow resistance located downstream of the metered addition point is at least approximately 50% of a total flow resistance of the at least one conduit.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

The invention shall be described in greater detail below with reference to the drawings. They show.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
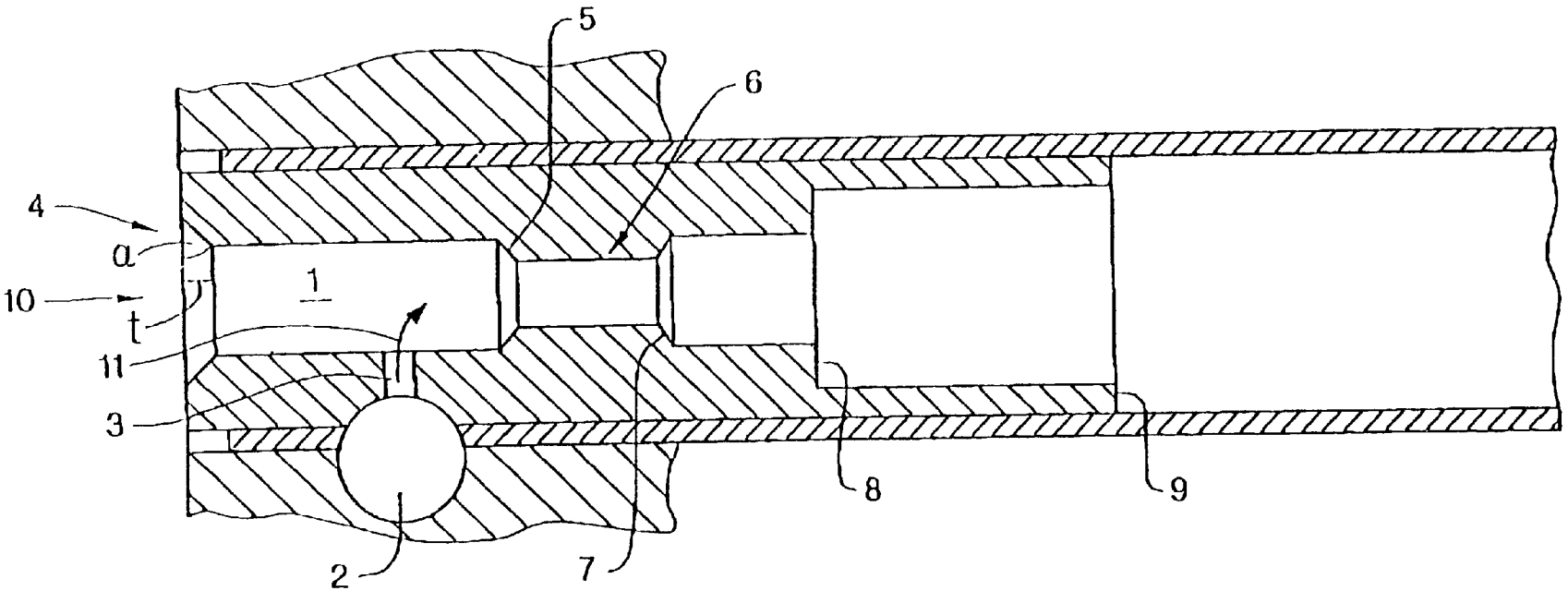
FIG. 1 shows a schematic depiction of a section of the headbox according to the invention in the region of the turbulence producer.

FIG. 1 shows a schematic depiction of the cross-section of a headbox in the region of a turbulence conduit 1.

Turbulence conduit 1 connects a material suspension distribution, which runs the width of the machine (left side), with the headbox nozzle (right side). Turbulence conduit 1 has a strong bezel 4 at the entrance side which is destined to decrease the intake pressure loss at this point. A cylindrical part of conduit 1 then follows into which a metered addition opening 3 opens. Metered addition opening 3 is fed by way of a supply conduit 2 which supplies a fluid medium. Passing through metered addition opening 3, a regulated amount of fluid medium can be supplied to the material suspension flow in the headbox. The main flow direction of the material suspension flow is shown by the arrow 10. The flow direction 11 of the metered addition fluid runs essentially perpendicularly to main flow direction 10 in this initial region.

Downstream of the metered addition point, a conical narrowing 5 of conduit 1 occurs which transitions into a region of greatest narrowing 6 inside conduit 1. Further down the flow course, conduit 1 widens conically to a first diameter, followed by a first protrusion 8 and then to a second diameter followed by a second protrusion 9, each of which extends the cross-section of conduit 1 and resembles steps.

This construction of conduit 1 and the relative positioning of metered addition opening 3, allows for a main pressure loss to occur in the region of greatest narrowing 6 which, seen in the flow direction, is arranged downstream from the metered addition point. As a result of this configuration, the influence of the metered addition on the entire flow rate in conduit 1 is very low, and causes very limited fluctuations in the total flow rate to occur when different amounts of fluid medium are additional fed into conduit 1 via metered addition opening 3.

Figure 2:
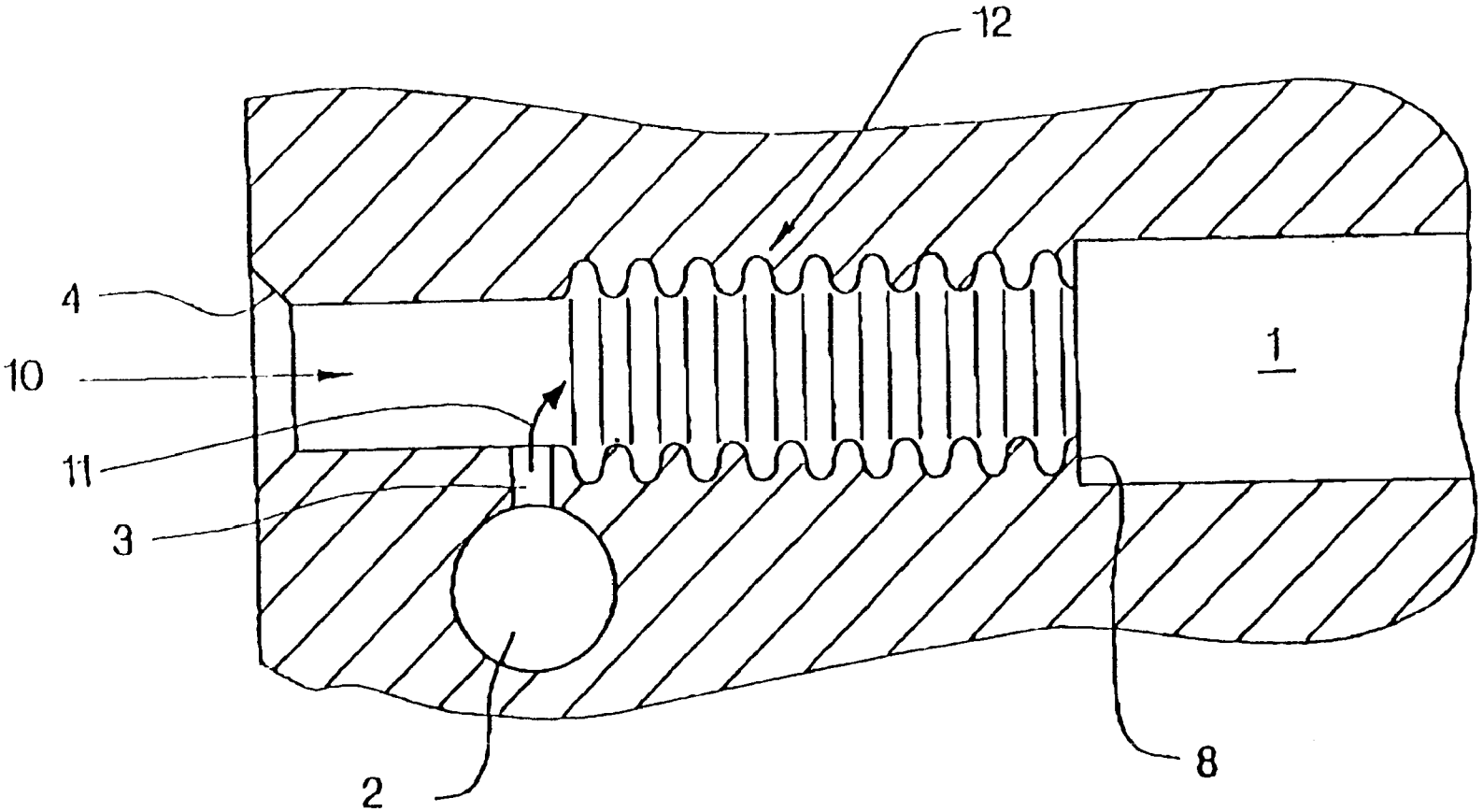
FIG. 2 shows a turbulence conduit with a corrugated tube contour.

Another embodiment is shown in FIG. 2. Shown here is a section of the turbulence producer of a headbox with the material suspension supplying conduit 1 and metered addition opening 3 for a fluid medium in conduit 1. In the entrance region, conduit 1 is provided with a pressure loss-reducing bezel 4, followed by a straight path of conduit 1 into which metered addition opening 3 opens. Downstream from metered addition opening 3, the straight path of conduit 1 transitions into a wave contour 12 in which the main pressure loss in conduit 1 is produced. Subsequent to wave contour 12, first step protrusion 8 occurs, followed by an essentially undisturbed cylinder-shaped path.

This embodiment also provides for the main part of the total pressure loss as well as of the total resistance to occur downstream of the metered addition point.

Figure 3:
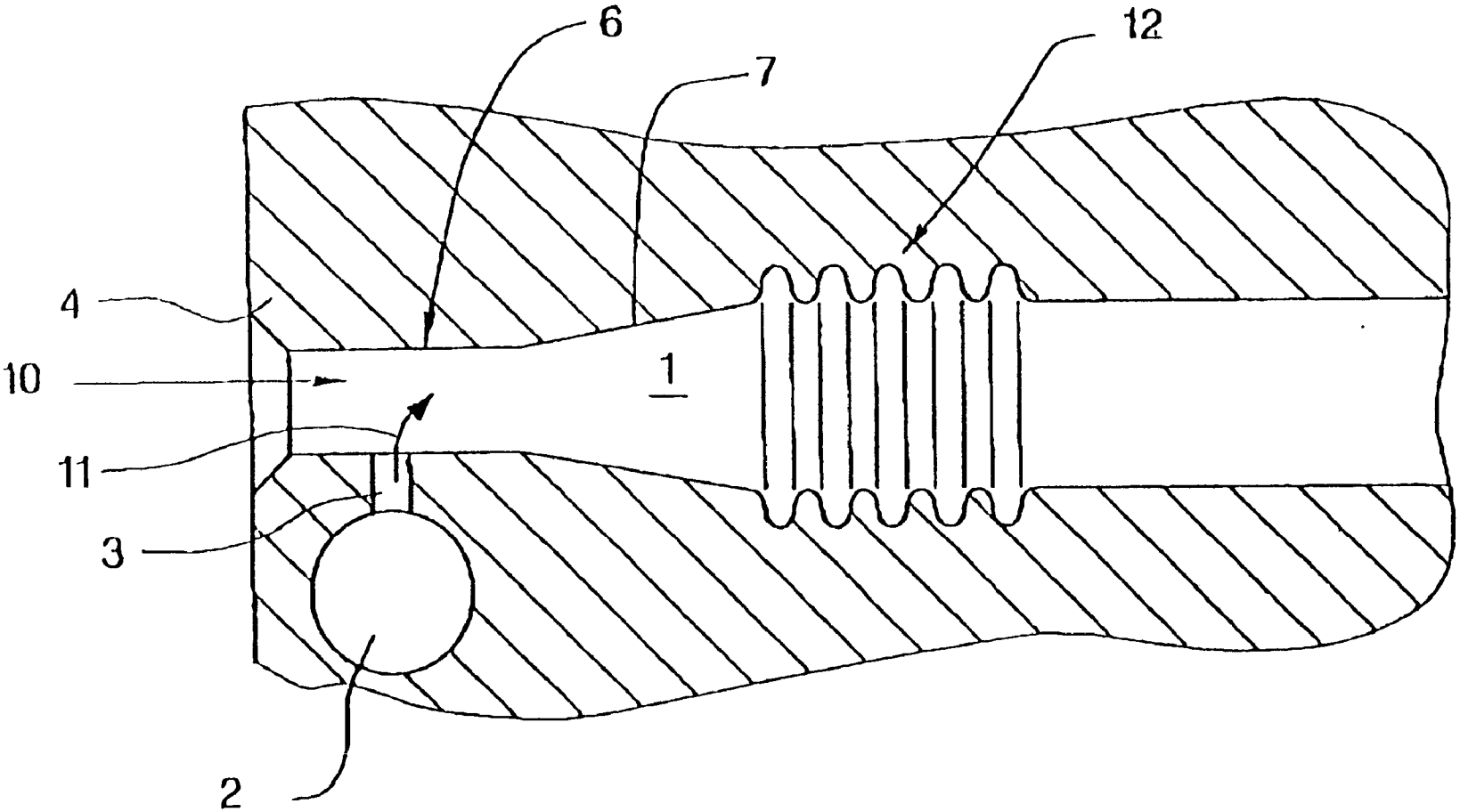
FIG. 3 shows a turbulence conduit with a corrugated tube contour and diffuser region.

FIG. 3 shows a variation of conduit 1 in which metered addition opening 3 for the fluid medium opens into conduit 1 in the course of greatest narrowing 6. Downstream of this narrowest region of conduit 1, a diffuser-like, conical expansion 7 of conduit 1 follows to wave contour 12 and transitions without any protrusion into a smooth, cylindrical section of conduit 1.

Figure 4:
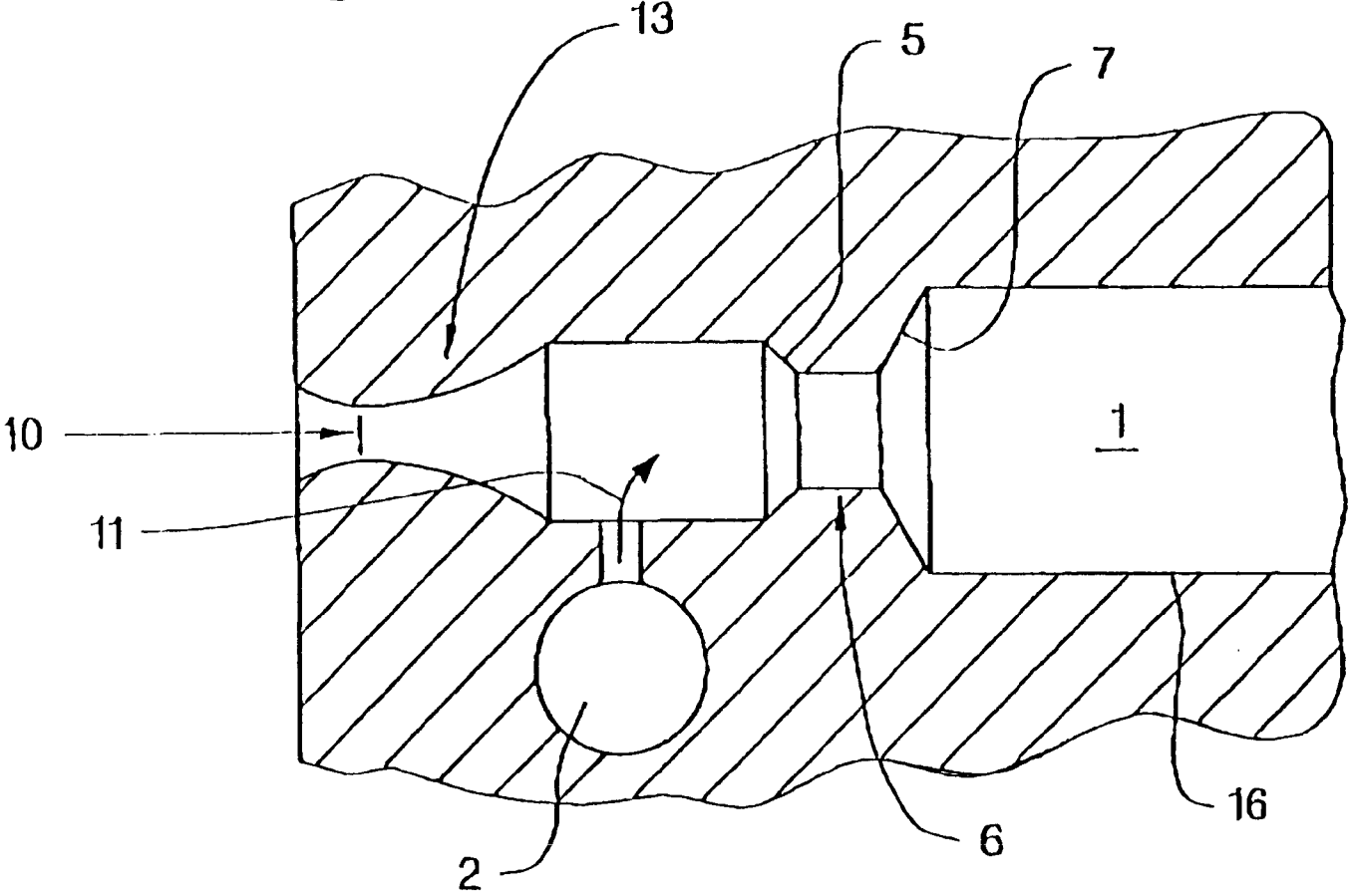
FIG. 4 shows a turbulence conduit with a Venturi contour.

FIG. 4 shows a further variation of conduit 1 of a headbox constructed according to the invention. For the purpose of reducing resistance, the entrance region is provided with venturi contour 13 having a parabola-like path and transitioning into a smooth, cylindrical section whose cross-section is greater than the entrance cross-section into the venturi opening. Metered addition opening 3 opens into this smooth, cylindrical section. Subsequently, conical narrowing 5 follows which transitions into narrowest cylindrical region 6, followed by conical expansion 7, which in turn is attached to smooth cylindrical region 16 having a relatively large cross-section.

This embodiment also shifts the main resistance and/or the main pressure loss downstream of the metered addition point for the fluid medium.

Figure 5:
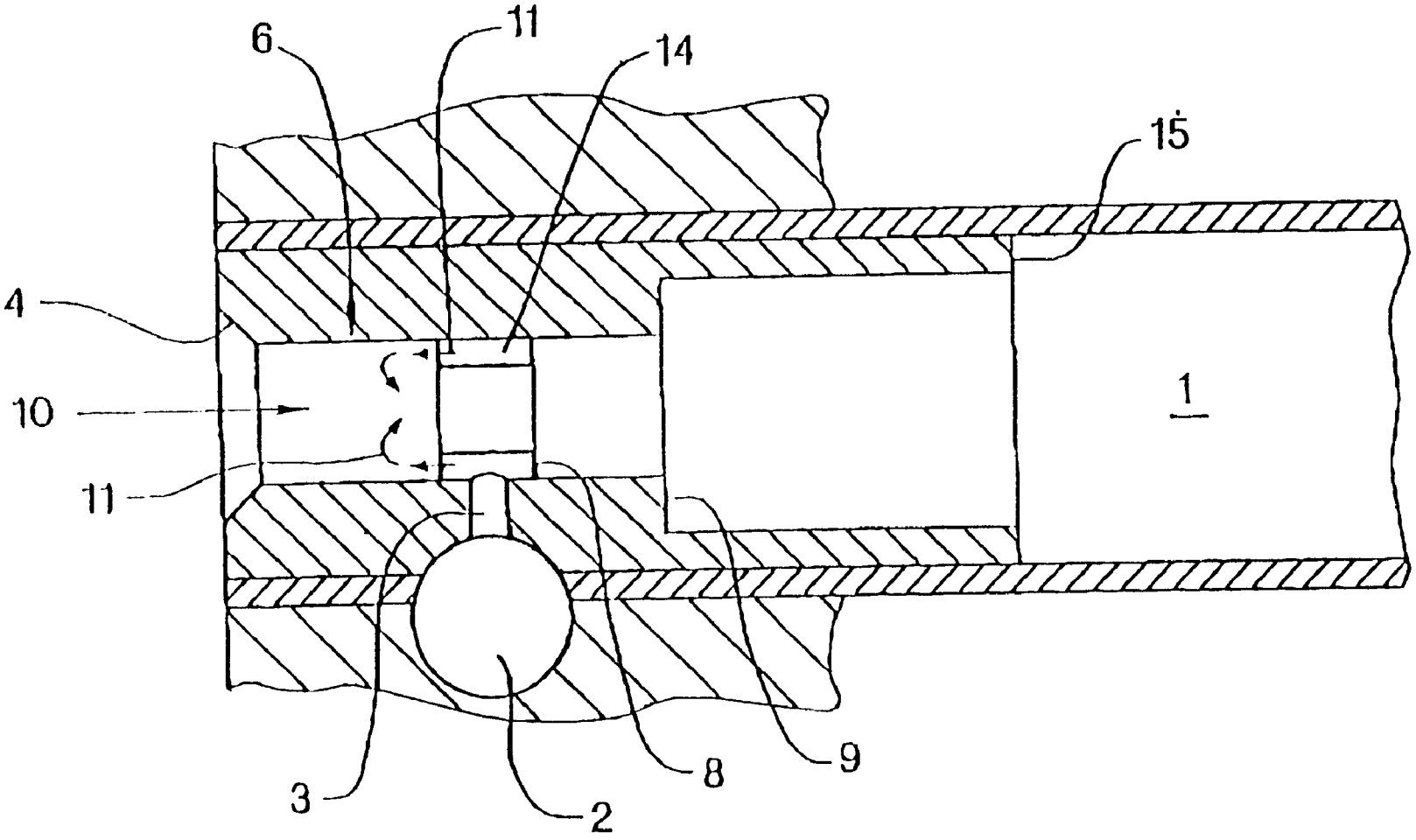
FIG. 5 shows a turbulence conduit with an annular gap.

FIG. 5 shows a further variation of the embodiment of metered addition point 3 in conduit 1. In this embodiment, relatively narrow cylindrical region 6 is again narrowed by annular gap 14 that is connected to metered addition opening 3 for the metered addition of a fluid medium. One or more openings are arranged on annular gap 14 on the conduit side for supplying the metered addition fluid in the opposite direction to main flow direction 10 of the material suspension flowing through conduit 1. The arrows designate flow from these openings. Annular gap 14 itself constitutes the narrowest point in the entire conduit 1, such that the greatest portion of the flow resistance, and thus of the pressure loss, is arranged downstream of the metered addition point for the fluid medium here as well.

In the further flow path of this embodiment, exclusively step-shaped protrusions are situated that produce additional pressure losses.

It should be noted that this form of fluid medium spraying into the conduit of the turbulence producer shown in FIG. 5 can also be used in all other embodiments shown.

In summary, the embodiment of the headbox according to the invention and/or the execution of the process according to the invention in the headbox shown allow the total flow rate through a conduit of the turbulence producer to remain independent of the amount of fluid medium added to the flow of the greatest extend and thus to have hardly any influence on the fiber orientation cross profile or the basis weight cross profile.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

| | |
|---|---|
| 1 | Conduit |
| 2 | Supply conduit for a fluid medium |
| 3 | Metered addition opening |
| 4 | Bezel |
| 5 | Conical narrowing |

-continued

| LIST OF REFERENCE NUMBERS | |
|---|---|
| 6 | Cylindrical region |
| 7 | Conical expansion |
| 8 | First protrusion |
| 9 | Second protrusion |
| 10 | Main flow direction |
| 11 | Flow direction of the added fluid |
| 12 | Wave contour |
| 13 | Venturi contour |
| 14 | Annular gap |
| 15 | Third protrusion |
| 16 | Smooth cylindrical section |
| t | Depth of bezel |
| α | Bezel angle |

What is claimed is:

1. A process for a metered addition of a fluid medium into a material suspension stream of a headbox comprising:

feeding a material suspension in a main flow direction through at least one turbulence-producing conduit to a headbox nozzle, said at least one turbulence-producing conduit having an entrance, a graduated pressure loss area, and an exit;

causing a total pressure loss $\Delta P_{total}$ in said at least one turbulence-producing conduit such that said total pressure loss $\Delta P_{total}$ comprises at least one intake pressure loss $\Delta P_{intake}$ formed at said entrance and a graduated pressure loss $\Delta P_{grad}$ formed at said graduated pressure loss area; and providing the metered addition of the fluid medium in a region between said entrance and said exit, wherein at least approximately 50% of said total pressure loss $\Delta P_{total}$ is produced downstream of said metered addition.

2. The process of claim 1, wherein said total pressure loss $\Delta P_{total}$ produced downstream of said metered addition of said fluid medium does not exceed approximately 75%.

3. The process of claim 2, wherein said total pressure loss $\Delta P_{total}$ produced downstream of said metered addition of a fluid medium is in the range of approximately 50% to 60%.

4. A process for a metered addition of a fluid medium into a material suspension stream of a headbox comprising:

feeding a material suspension in a main flow direction through at least one turbulence-producing conduit to a headbox nozzle, said at least one turbulence-producing conduit having an entrance, a graduated pressure loss area, and an exit;

causing a total pressure loss $\Delta P_{total}$ in said at least one turbulence-producing conduit such that said total pressure loss $\Delta_{total}$ comprises at least one intake pressure loss $\Delta P_{intake}$ formed at said entrance and a graduated pressure loss $\Delta P_{gra}$ formed at said graduated pressure loss area; and providing the metered addition of the fluid medium in a region between said entrance and said exit, wherein said total pressure loss $\Delta P_{total}$ is any value in a range of approximately $0.3\times10^5$ Pa to $8\times10^5$ Pa.

5. The process of claim 4, wherein said total pressure loss $\Delta P_{total}$ is any value in the range of approximately $4\times10^5$ Pa to $8\times10^5$ Pa.

6. A process for a metered addition of a fluid medium into a material suspension stream of a headbox comprising:

feeding a material suspension in a main flow direction through a plurality of turbulence-producing conduits to a headbox nozzle, said plurality of turbulence-producing conduits having an entrance, a graduated pressure loss area, and an exit;

causing a total pressure loss $\Delta P_{total}$ in said plurality of turbulence-producing conduits such that said total pressure loss $\Delta P_{total}$ comprises at least one intake pressure loss $\Delta P_{intake}$ formed at said entrance and a graduated pressure loss $\Delta P_{grad}$ formed at said graduated pressure loss area; and providing the metered addition of the fluid medium in a region between said entrance and said exit, wherein at least approximately 50% of said total pressure loss $\Delta P_{total}$ is produced downstream of said metered addition.

* * * * *